US005740003A

United States Patent [19]

Seymour et al.

[11] Patent Number: 5,740,003

[45] Date of Patent: Apr. 14, 1998

[54] CIRCUIT BREAKER SHUNT TRIP ACCESSORY WITH MECHANICAL OVERRIDE

[75] Inventors: Raymond K. Seymour; Michael R. Koller, both of Plainville, Conn.

[73] Assignee: General Electric Company, New York, N.Y.

[21] Appl. No.: 715,723

[22] Filed: Sep. 19, 1996

[51] Int. Cl.[6] ..... H01H 73/00

[52] U.S. Cl. ..... 361/115; 361/154; 335/38

[58] Field of Search ..... 361/115, 102, 361/154; 335/171, 172, 174, 192, 203, 236, 238, 251, 255, 274, 21, 38, 41, 42, 46

[56] References Cited

U.S. PATENT DOCUMENTS

| | | | |
|---|---|---|---|
| 3,693,122 | 9/1972 | Willard | 335/174 |
| 3,852,646 | 12/1974 | Mason | 361/154 |
| 4,001,742 | 1/1977 | Jencks et al. | 335/173 |
| 4,453,652 | 6/1984 | Merkel et al. | 222/504 |
| 4,513,241 | 4/1985 | Bowman | 323/285 |
| 4,672,501 | 6/1987 | Bilac et al. | 361/96 |
| 4,679,116 | 7/1987 | Oshizawa et al. | 361/154 |
| 4,729,056 | 3/1988 | Edwards et al. | 361/153 |
| 4,786,885 | 11/1988 | Morris et al. | 335/202 |
| 4,833,563 | 5/1989 | Russell | 361/92 |
| 4,965,543 | 10/1990 | Batteux | 335/174 |
| 5,381,297 | 1/1995 | Weber | 361/153 |
| 5,453,724 | 9/1995 | Seymour et al. | 335/172 |
| 5,548,263 | 8/1996 | Bulgatz et al. | 335/274 |

OTHER PUBLICATIONS

U.S. application Ser. No. 08/614,084, Seymour & Castonguay, Modular Accessory Mechanical Lock-Out Mechanism, Mar. 12, 1996.

*Primary Examiner*—Jeffrey A. Gaffin
*Assistant Examiner*—Michael J. Sherry
*Attorney, Agent, or Firm*—Richard A. Menelly; Carl B. Horton

[57] ABSTRACT

A circuit breaker shunt trip accessory unit contains a solenoid driven plunger that interacts with the circuit breaker operating mechanism to interrupt circuit current by means of an external signal. A mechanical override feature insures operation of a blocked solenoid plunger once the source of the blocking is removed.

13 Claims, 3 Drawing Sheets

CIRCUIT BREAKER SHUNT TRIP ACCESSORY WITH MECHANICAL OVERRIDE

BACKGROUND OF THE INVENTION

U.S. Pat. No. 4,672,501 entitled "Circuit Breaker and Protective Relay Unit" describes the use of a digital circuit interrupter employing a microprocessor in combination with ROM and RAM memory elements to provide both relaying as well as overcurrent protection function to an electrical distribution system.

U.S. Pat. No. 4,833,563 entitled "Molded Case Circuit Breaker Actuator-Accessory Module" describes an integrated protection unit that includes basic overcurrent protection facility along with selective electrical accessories. A specific actuator-accessory module is selected to give the required accessory function along with basic overcurrent protection.

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism controls the powerful operating springs that open and close the circuit breaker contacts.

U.S. Pat. No. 4,786,885 entitled "Molded Case Circuit Breaker Shunt Trip Coil" and U.S. Pat. No. 5,453,724 entitled "Flux Shifter Assembly for Circuit Breaker Accessories" both describe the use of flux shifter devices in combination with circuit interruption devices. Shunt trip accessories include a solenoid winding arranged around a plunger to extend the plunger under electromagnetic force into contact with the circuit breaker trip bar to articulate the circuit breaker operating mechanism and separate the circuit breaker contacts. In addition, the solenoid can be used to interact with a lockout mechanism described in U.S. Pat. application Ser. No. 08/614,084 filed on 12 Mar., 1996, entitled "Circuit Breaker Accessory Lock-Out Mechanism". In the event the plunger is prevented from extension by means of an intervening event, the plunger could remain unextended after the intervening event has passed.

It would be highly beneficial to insure that the solenoid plunger within the shunt trip accessory is able to extend upon receipt of trip signal at all times to insure that the tripping function is accomplished. One purpose of the invention, accordingly, is to describe a shunt trip accessory wherein the plunger will at all times become extended upon receipt of a trip signal.

SUMMARY OF THE INVENTION

A circuit breaker shunt trip accessory unit contains a solenoid-driven plunger that interacts with the circuit breaker operating mechanism to interrupt circuit current by means of an external signal. A non-ferrous pin is arranged within the plunger and is spring-biased against the plunger interior. Upon occurrence of a blocked plunger condition, the pin is extended to interact with the circuit breaker operating mechanism as soon as the blocking source is removed.

DESCRIPTION OF THE PREFERRED EMBODIMENT

Figure 1:
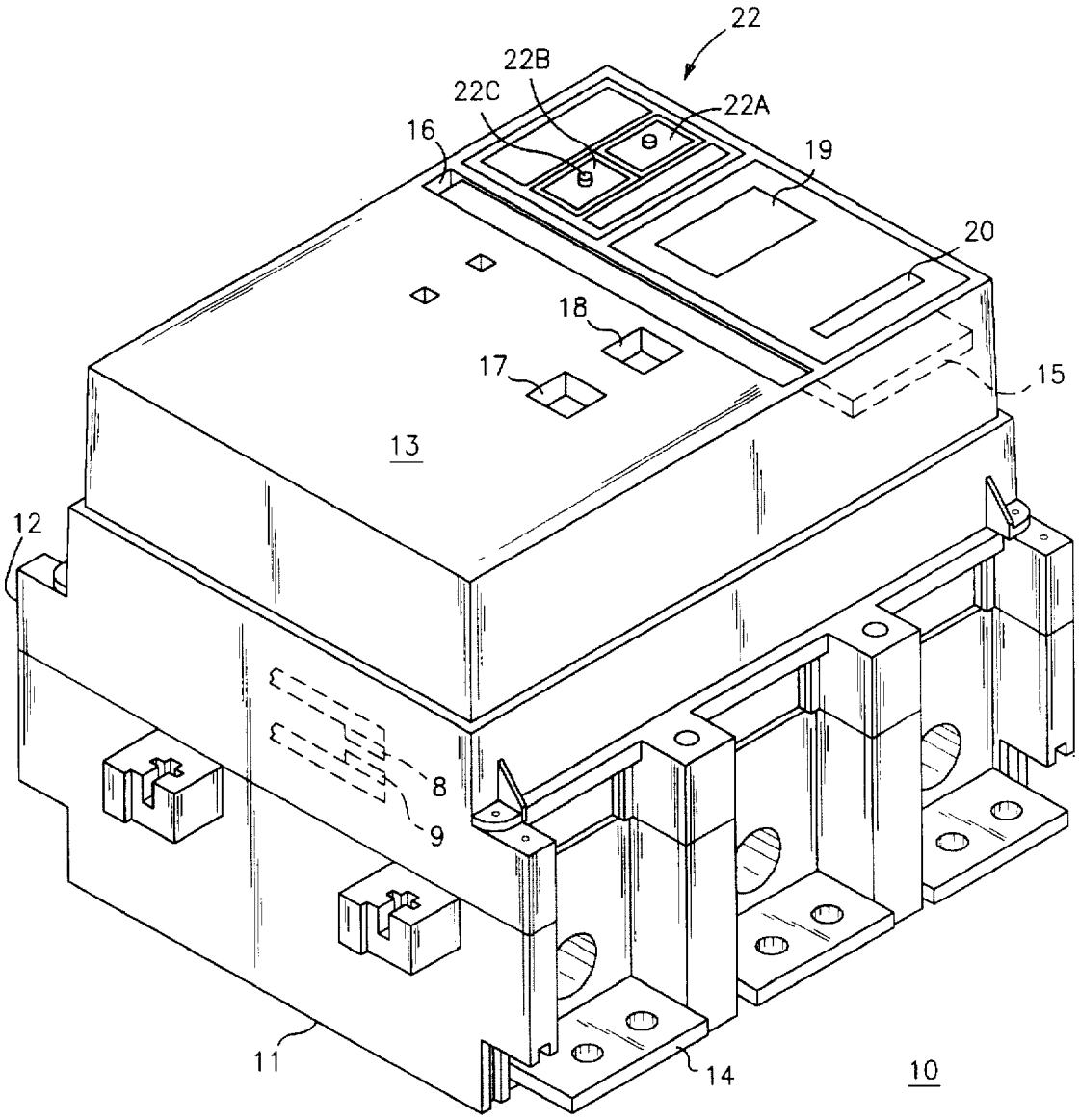
FIG. 1 a schematic representation of a digital circuit interrupter that includes the shunt trip accessory according to the invention.

The high ampere-rated circuit breaker 10 shown in FIG. 1 is capable of transferring several thousand amperes quiescent circuit current at several hundred volts potential. The circuit breaker consists of an electrically insulated base 11 to which an intermediate cover 12 of similar insulative material is attached prior to attaching the top cover 13 also consisting of an electrically-insulative material. Electrical connection with the interior current-carrying components is made by load terminal straps 14 extending from one side of the base through a pair of separable contacts 8, 9 and then through the line terminal straps (not shown) extending from the opposite side thereof. The interior components are controlled by an electronic trip unit 15 contained within the top cover 13. The trip unit is similar to that described within aforementioned U.S. Pat. No. 4,672,501 and interacts further with a bell alarm unit accessory 22A and shunt trip or flux shifter accessory 22B within an accessory recess 22 to provide local indication, by means of the signal flags 22C, of the conditions of the circuit breaker contacts. The operating handle 16 allows manual operation of the circuit breaker operating mechanism to open and close the circuit breaker contacts. The contacts can also be automatically opened and closed by means of buttons 17, 18 accessible on the top cover 13. The trip unit settings can be observed by means of the display 19 and the associate key pad 20.

Figure 2:
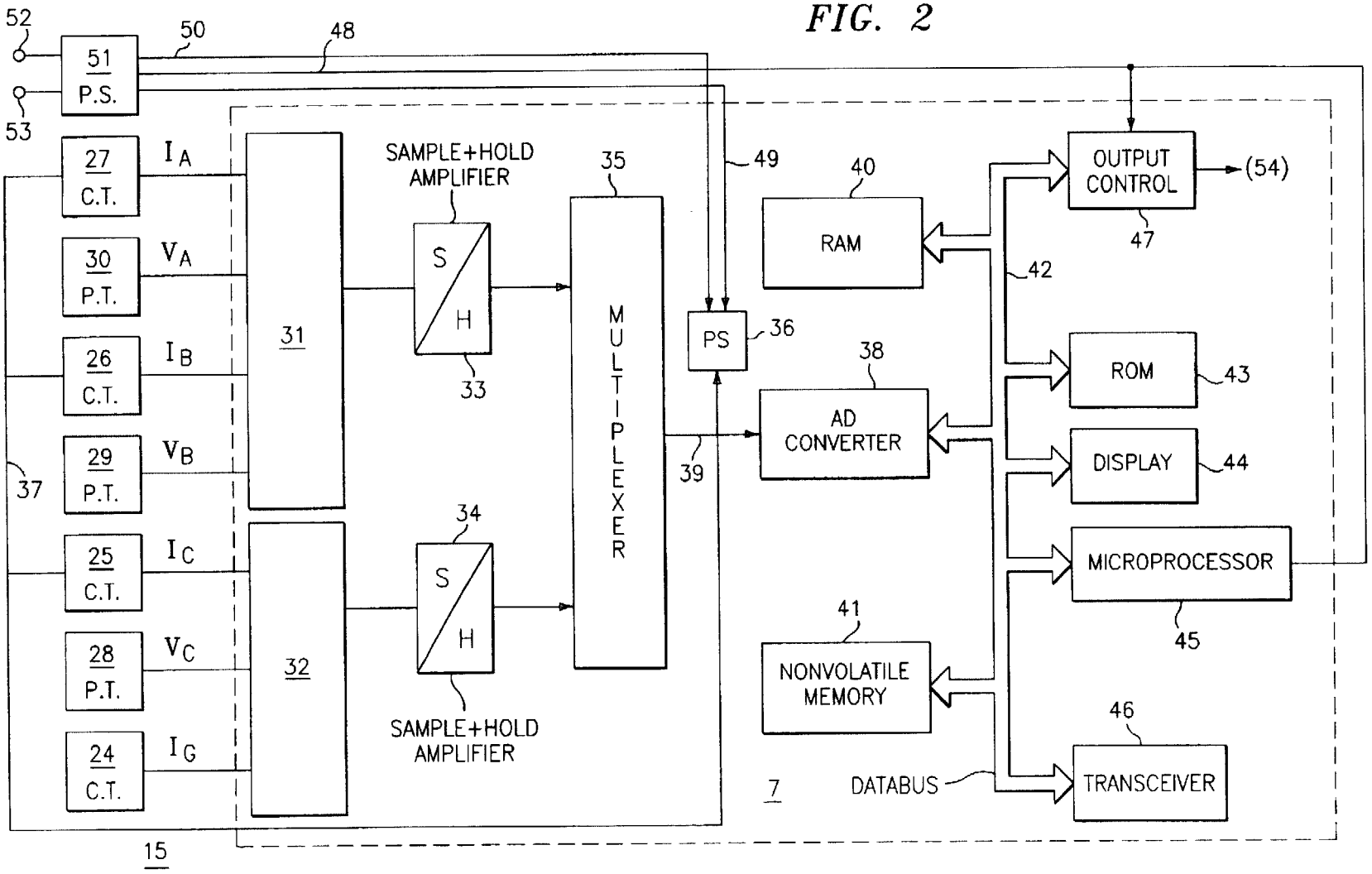
FIG. 2 an enlarged diagrammatic representation of the components within the electronic trip unit of FIG. 1.

As described within the aforementioned U.S. Pat. No. 4,672,501, the trip unit 15 is contained on a printed circuit card 7 as shown in FIG. 2 to which external connection is made with current transformers 24–27 and potential transformers 28–30. The electrical input is transmitted through multiplexers 31, 32, 35 and sample and hold amplifiers 33, 34 to an A/D converter 38 by means of conductor 39. Circuit protection and control is achieved by utilization of a data bus 42 which is interconnected with an output control 47, transceiver 46, and RAM 40. The ROM 43, microprocessor 45, display 44, transceiver 46 and nonvolatile memory 41 operate in the manner described therein to insure complete overall circuit protection. Operating power to the printed circuit card 7 is supplied by the current transformers from the associated electrical distribution system over conductor 37. In accordance with the invention, shunt trip facility is provided by connection of a shunt trip module 51 with the microprocessor 45, output control 47 and the trip unit power supply 36 by means of conductors 48, 49 and 50. A shunt trip signal is outputted to a mechanical override shunt trip unit 54 of FIG. 3 from the output control to interrupt the circuit current. For purposes of this disclosure, the term "shunt trip" is defined as the provision of a trip signal to the circuit breaker trip unit independent of the circuit breaker trip unit which otherwise determines a trip operation based on the occurrence of an overcurrent condition. The shunt trip signal is often supplied to the terminals 52, 53 by an operator remote from the circuit breaker location to either test the circuit breaker operating components or to electrically disconnect the associated electrical equipment for replacement or repair. The occurrence of the shunt trip interruption is transmitted to the microprocessor for storage and display. The shunt trip module supplies energy to power up the trip unit as well as energy to power up the solenoid in case no current is flowing within the electrical distribution system.

Figure 5:
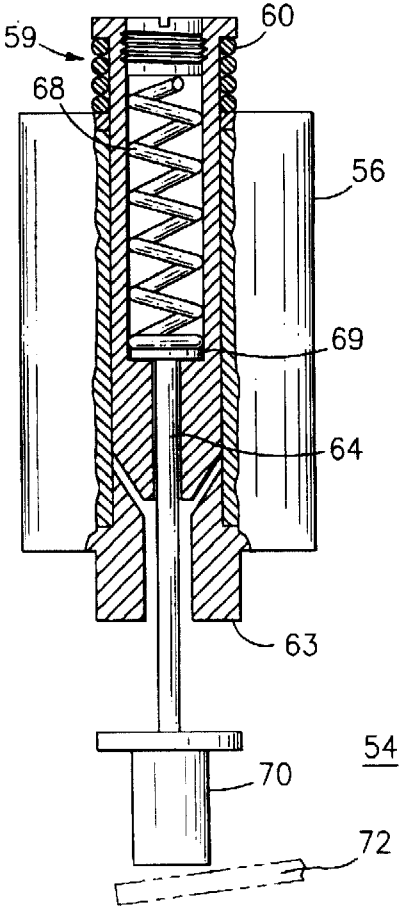
FIGS. 4 and 5 are front views of the shunt trip accessory of FIG. 3 in partial section, after actuation.
Figure 3:
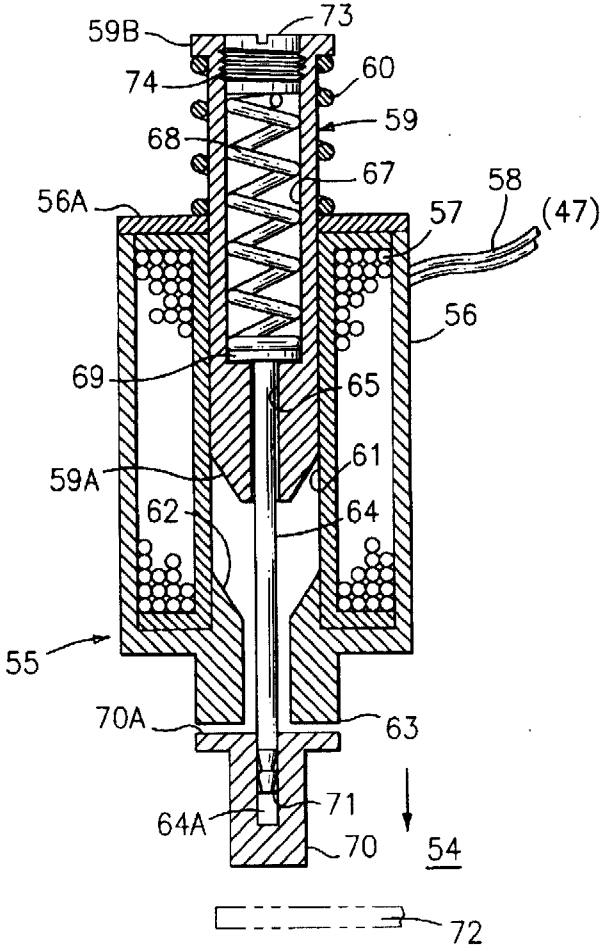
FIG. 3 is a front sectional view of the shunt trip accessory of the invention prior to actuation.

In further accordance with the invention, a mechanical override shunt trip unit 54, hereinafter "MOST", is depicted jointly within FIGS. 3–5. The MOST includes a solenoid unit 55 within a cylindrical metal housing 56 containing a solenoid coil 57 to which operating power is provided from the trip unit output control 47 of FIG. 2 over conductors 58. The plunger 59 is fabricated from a ferrous metal in order to receive electromotive force from the solenoid winding 57 and move forward within the large cylindrical passage 61 formed within the housing. A plunger return spring 60 is trapped between the plug 73, received within the threaded opening 74 at the rear 59B of the plunger 59, and the top 56A of the housing 56 to return the plunger from the extended position shown in FIG. 5 to the home position shown in FIG. 4. The sloped front part 59A of the plunger strikes against the stop surface 62 formed within the housing 56 when the plunger is fully extended. The mechanical override function is provided by means of the non-ferrous metal pin 64 that extends within a second elongated cylindrical passage 65 extending within the front 59A of the plunger 59. The pin includes a serrated front end 64A pressed within a slot 71 formed within an elongated button 70. The base 70A of the button rests against the front end 63 of the housing 56 as shown in FIG. 3. The opposite end of the pin 64 terminates in a pin plate 69 that abuts against one end of a pin compression spring 68 arranged within a third elongated cylindrical passage 67 formed within the plunger 59. When a first voltage pulse is applied over conductors 58, the plunger 59 is driven forward along the passage 61 compressing the return spring 60 and driving the pin 64 in the indicated direction in FIG. 3, by means of the pin spring 68 and the pin plate 69 causing the button 70 to strike the circuit breaker trip lever 72, indicated in phantom and articulate the circuit breaker operating mechanism to separate the contacts 8, 9 shown in FIG. 1.

Figure 4:
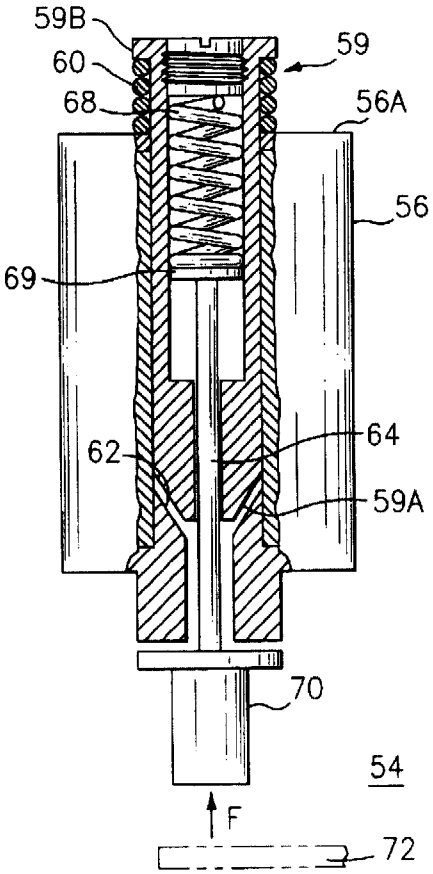

In the event that the MOST 54 is unable to release the button 70 into contact with the trip lever 72 by an intervening event, depicted by the force vector shown in FIG. 4, the front 59A of the plunger 59 bottoms against the stop 62. The return spring 60 becomes compressed between the rear 59B of the plunger 59 and the top 56A of the housing 56 while, at the same time, the pin spring 68 becomes compressed between the pin plate 69 and the rear 59B of the plunger 59. Upon removal of the intervening event, the bias provided by compressed pin spring 68 extends the button 70 away from the front 63 of the housing 56 to strike the trip lever 72, as shown in FIG. 5, and separate the circuit breaker contacts. As described in the aforementioned U.S. Pat. No. 5,453,724, the actuator signal to the solenoid 55 over conductors 58 (FIG. 3) is applied in two stages. The first stage is the application of sufficient voltage to excite the solenoid coil 57 to provide maximum electromotive force to accelerate the plunger 59. The second stage is the application of reduced voltage to hold the plunger in the extended position for a sufficient time period to allow the circuit breaker operating mechanism to respond and to retain the plunger until and unless the circuit breaker operating mechanism has become reset. The second stage is sufficient to restrain the plunger 59 from moving back to the home position of FIG. 3 under the return bias exerted by the return spring 60. When the operating mechanism is reset, the voltage signal to the solenoid is removed and the return bias of the return spring 60 overcomes the bias exerted by the pin spring 68 and drives the pin spring, pin 64 and plunger 59 simultaneously back to the home position of FIG. 3.

A circuit breaker shunt trip device having mechanical override function has herein been disclosed. The override allows the shunt trip to become operational after an intervening blocking event has ceased to occur.

We claim:

1. A flux shifter device comprising:

a housing;

a solenoid within said housing, said solenoid including a coil and a plunger, said plunger being arranged for propulsion to an extended position when said coil is supplied with a first voltage and being held in said extended position when said coil is supplied with a second voltage;

a return spring arranged for returning said plunger to a home position when said second voltage is removed;

tripping means within said housing, said tripping means arranged for propulsion outside said housing when said coil is supplied with said second voltage and said plunger remains in said extended position;

said plunger includes a cylindrical passage;

said tripping means is arranged partially within said passage;

said tripping means comprises a non-ferrous metal pin;

said pin terminates within a button at one end and at a pin plate at an opposite end; and said pin plate is captured in said cylindrical passage within said plunger.

2. The flux shifter of claim 1 wherein said tripping means includes a compression spring.

3. The flux shifter of claim 1 including a stop formed within said housing intermediate said plunger and an opening at one end of said housing, whereby said plunger abuts against said stop when said coil is supplied with said first voltage.

4. The flux shifter of claim 1 wherein said plunger includes threads at one end for attaching a plug at said one end.

5. The flux shifter of claim 4 wherein said plunger includes a tapered end opposite said plug.

6. A circuit breaker comprising:

a molded case and a cover attached to said case;

a pair of separable contacts within said case and arranged for electrical connection within an electric circuit;

an electronic trip unit within said cover, said trip unit arranged for separating said contacts upon occurrence of an overcurrent condition within said electric circuit;

a shunt trip unit within said cover, said shunt trip unit arranged for separating said contacts upon receipt of a first electrical signal, said shunt trip unit comprising a housing;

a solenoid within said housing, said solenoid including a coil and a plunger, said plunger being arranged for propulsion to an extended position when said coil is supplied with a first voltage and being held in said extended position when said coil is supplied with a second voltage, said plunger including a cylindrical passage;

a return spring arranged for returning said plunger to a home position when said second voltage is removed; and tripping means within said housing, said tripping means arranged for propulsion outside said housing when said coil is supplied with said second voltage and said plunger remains in said extended position, said tripping means comprising a non-ferrous metal pin, said pin terminating within a button at one end and at a pin plate at an opposite end; and said pin plate is captured in said cylindrical passage within said plunger.

7. The circuit breaker of claim 6 wherein said tripping means is arranged partially within said passage.

8. The circuit breaker of claim 6 wherein said tripping means includes a compression spring.

9. The circuit breaker of claim 6 including a stop formed within said housing intermediate said plunger and an opening at one end of said housing, whereby said plunger abuts against said stop when said coil is supplied with a first voltage.

10. The circuit breaker of claim 1 wherein said plunger comprises a cylinder of ferrous metal.

11. The circuit breaker of claim 1 wherein said plunger includes threads at one end for attaching a plug at said one end.

12. The circuit breaker of claim 11 wherein said plunger includes a tapered end opposite said plug.

13. The circuit breaker of claim 6 wherein said button terminates at a base in abutment with said end of said housing.

* * * * *